US005971401A

United States Patent [19]

Lübbers et al.

[11] Patent Number: 5,971,401

[45] Date of Patent: Oct. 26, 1999

[54] RING SEAL FOR APERTURES OF MULTI-SHELLED STRUCTURES, ESPECIALLY OF UNDERGROUND OPERATION

[75] Inventors: Bernhard Lübbers, Dorsten; Werner Floors, Oer-Erkenschwick, both of Germany

[73] Assignee: Beton - Und Monierbau GmbH, Recklinghausen, Germany

[21] Appl. No.: 08/642,249

[22] Filed: Apr. 30, 1996

[30] Foreign Application Priority Data

May 2, 1995 [DE] Germany ..... 195 15 377
Apr. 30, 1996 [DE] Germany ..... 196 17 268

[51] Int. Cl.[6] ..... F16J 15/48; F16L 7/02

[52] U.S. Cl. ..... 277/605; 277/645

[58] Field of Search ..... 277/605, 645, 277/646, 652

[56] References Cited

U.S. PATENT DOCUMENTS

| | | | |
|---|---|---|---|
| 3,339,931 | 9/1967 | Hundt et al. | 277/605 |
| 3,341,974 | 9/1967 | Ganzinotti | 277/646 |
| 3,473,829 | 10/1969 | Daniels | 277/605 |
| 4,159,829 | 7/1979 | Ditcher . | |
| 4,269,419 | 5/1981 | Brant | 277/605 |
| 4,371,175 | 2/1983 | Van Dyk, Jr. | 277/646 |
| 4,410,185 | 10/1983 | Sporre | 277/605 |
| 4,508,355 | 4/1985 | Ditcher | 277/605 |
| 5,271,630 | 12/1993 | Arlt, III et al. | 277/605 |

*Primary Examiner*—Anthony Knight
*Assistant Examiner*—John L. Beres
*Attorney, Agent, or Firm*—Kinney & Lange, P.A

[57] ABSTRACT

With a ring seal for apertures of multi-shell structures, especially of underground operations, by which a tubular sealing element after insertion into the ring aperture between shells of the structure and after introduction of a filler material into the sealing element with the required sealing pressure, which is applied to the bordering shell surfaces of the aperture, is provided, according to the invention, that the sealing element, consisting of at least one tubing with ends inserted into each other, upon insertion into the aperture with the excess of its periphery provided opposite the periphery of the aperture and through the shortening of the overlap of its ends in the aperture as well as the stretching of the sealing element is applied axially and radially.

20 Claims, 7 Drawing Sheets

RING SEAL FOR APERTURES OF MULTI-SHELLED STRUCTURES, ESPECIALLY OF UNDERGROUND OPERATION

BACKGROUND OF THE INVENTION

The invention concerns a ring seal for apertures of multi-shell structures especially of underground operation.

The invention is related especially to ring seals in shaft and tunnel construction, as well as in sewer construction, where often a multi-shell structure is provided as an exterior construction of the underground cavity. The outside of the structure can thereby consist of the exposed rock wall or of a preliminary structure, for the most part realized with sprayed concrete. The interior shell of a structure of this kind, which forms the inner shell of the ring aperture, consists then, as a rule, of a static load-bearing structure in concrete or reinforced concrete, for which waterproof concrete (so-called WU-concrete) is a possibility. The ring seal concerned in this invention serves with the help of a hollow sealing element for the frontal sealing of the ring aperture, in order to stop the flow of either water or sludge from this aperture, or to fill up the circular space behind the frontal seal.

It is known how to construct the specific sealing element out of a self-enclosed ring with a circular cross-section as a so-called O-ring seal with an unending rubber tube, which has a filling from air or a fluid. O-ring seals of this kind are specially manufactured and designed for each individual case. They require a firm seat as the seal clamping fixture into which they are built. Such O-ring seals are technically expensive. Since they are applied to a specific ring aperture width and diameter, changes in the form of the ring have negative consequences of the sealing, possibly the ring aperture diameter and breadth differing from each other. Since one can seal only the concerned ring aperture with the ring seal designed for the individual installation case, but this is to be followed under the given relationships only with relatively great tolerances, a sufficient sealing of the ring aperture by using these O-ring seal causes considerable difficulty in some circumstances. In particular, differing internal diameters determined by the procedure, which might, for example, be made necessary by the thrusting technology or even by other reasons, can be sealed only with two sealing elements of the kind described, built in next to each other. Then, for reasons of space, there often result difficulties in the installation of these multiple sealing elements.

Beyond this, such sealing elements are not secure against leakage of their filling, which leads to the failure of the ring aperture seal, since the sealing pressure is lost. It is common to the described ring aperture seals that either they must be disposed of after the end of the work, or after the completion of the structure they form a so-called "soft spot" in the statics of the structure. With this it must also be considered that the known O-ring seals conditioned by the manner of construction resist only limited counter-pressures. With air-filled sealing elements the counter-pressures are, as a consequence of the air-pressure container regulation, limited to allowable values, which can easily be inadvertently surpassed in the finished structure underground.

SUMMARY OF THE INVENTION

The present invention is a ring seal for a multi-shelled structure. The ring seal includes a tubular sealing element formed of a tubular casing flexible material. Ends of the tubular casing are inserted one into the other in an overlapping fashion to form an annular tubular sealing element. The tubing sealing element is then inserted into the ring aperture between shells of the multi-shelled structure. After insertion, a filler material is introduced into the tubular sealing element with the required sealing pressure. The tubular sealing element includes an excess of its periphery provided opposite the periphery of the aperture. When the filler material is introduced, the filler material stretches the flexible material of the tubular sealing element and shortens the overlap of the ends to apply a seal axially and radially between the shells of the structure.

DESCRIPTION OF PREFERRED EMBODIMENTS

Figure 1:
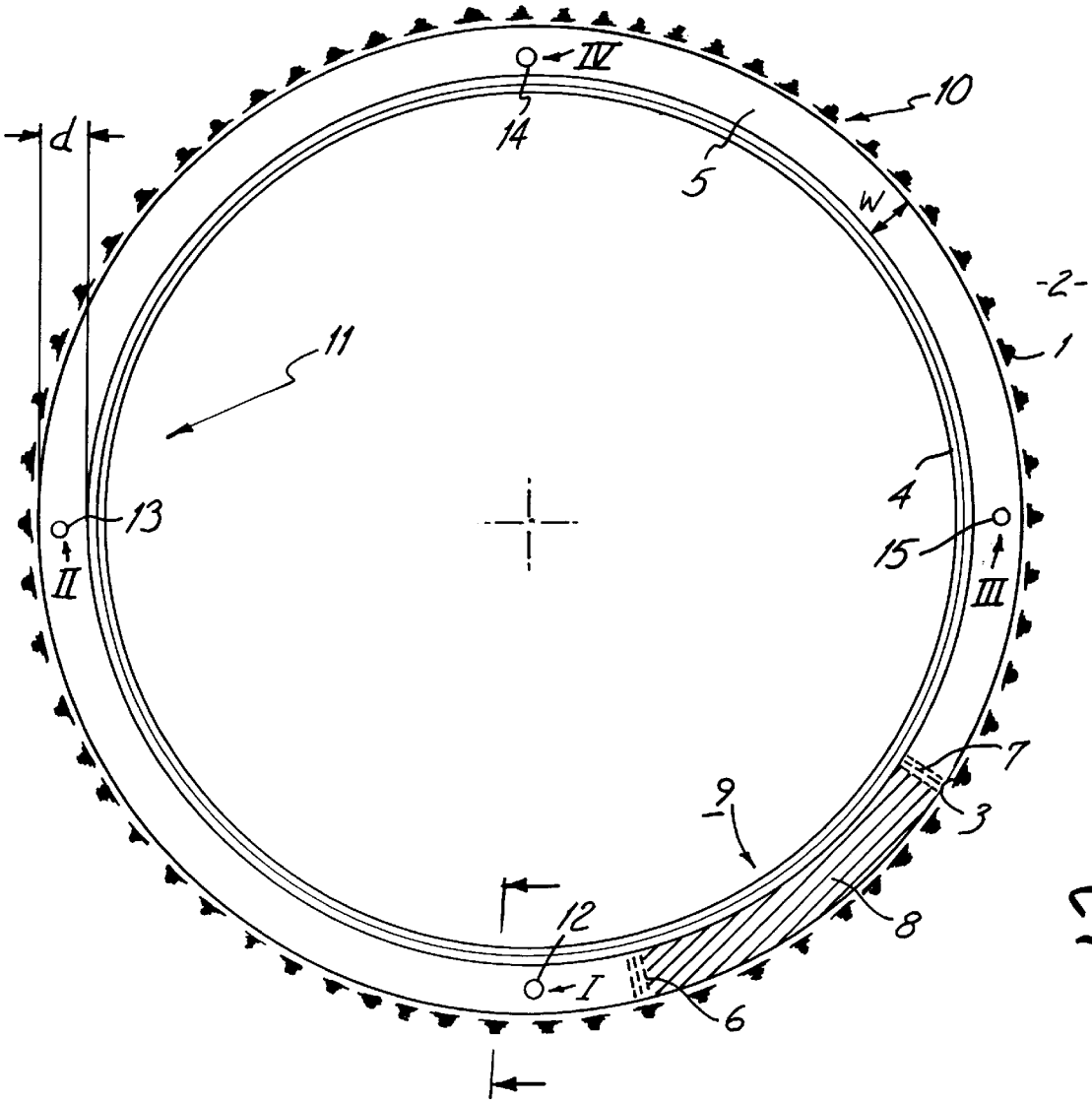
FIG. 1 is a cross-sectional view of a multi-shelled structure with a ring aperture seal of textile tubing material installed.

According to the invention, the known mounting procedure, presupposed as known for the O-ring seals, is retained, with which the sealing element, after insertion into the ring aperture between the shells of the structure and after the introduction of a filling material into its cavity with the required sealant pressure, is applied to the shell surfaces that border the ring aperture. This is advantageous, since by this nothing needs to be fundamentally changed in the constructional erection of the structure. According to this invention, however, with the ends of the actual sealing elements stuck into each other, most of the aforementioned disadvantages are eliminated. By this fact that, with the insertion into the ring aperture, the sealing element is provided with an excess of its diameter in relation to the inner diameter of the aperture and, by shortening the overlap of its ends, is enlarged in its extension in the ring aperture, an axial and radial installation of the tube into the ring aperture results. With this, depending on the individual case, enlarged installation surfaces are achieved, and differences of the ring aperture inner diameter and the ring aperture width are already compensated for with the filling of the sealing element. A preceding manufacture of the sealing element, as it has been described at the beginning for the previously known O-ring seal, does not occur, although the overlapping can be built already in the manufacturing plant or even at the installation site.

The sealing element, according to the invention, can be further simplified by having the tubular casing sealed against the escape of filler material which was introduced under pressure tunnel but at least partially opposed application of its ends inserted into each other. With this, the seal required between the ends in the overlap is obtained with the help of the filling material introduced under pressure, which increases the binding tension of the surrounding end and by this leads to the sealed connection of the ends that are inserted into each other. Such design forms of the invention have the further advantage that the sealing element can have a constant diameter throughout.

The material of the sealing element, especially that which is fashioned as tubing, is suitable, especially of textile material. The tubing can consist of cylindrically woven plastic fibers of correspondingly higher tensile strength. Through the kind of weave, e.g. linen or twill weave, a drainage effect occurs through the tube casing during filling with hardening construction material, which contributes to the rapid hardening of the construction material and thereby simplifies and speeds up the construction work.

The size of the overlap is dependent on the individual case, but as a rule will have a length of approx. 0.5 to approx. 2 m., if the first end of the tubular casing is closed and the filler material is introduced through one or more feeder fill valves beyond the overlap of the ends. Then with this the inserted tubing end is closed, so that the swelling and seating of the tubing end that lies within results in a direct coupling to the mounting, if the filling material is introduced beyond the overlap of the tubing ends through one or more filling valves leading into the tube of the sealing element.

In practice one can often distinguish the constructional-conditioned differing ring aperture widths from the process-conditioned differing ring aperture widths. The constructionally differing ring aperture widths are determined by the kind of construction and can, for instance, result from the irregular outbreak of the rock, possibly through explosive work. These are compensated by the sealing element itself, through the excess of the tubing periphery compared to the inner diameter of the ring aperture, without suffering a loss of sealing quality. With this, according to experience, it plays no essential role whether the ring aperture breadth difference occur on a broad surface, which is the case, for example, if the longitudinal axis of the interior shell of a multi-shelled structure is not identical with the longitudinal axis of the outer shell. For this—by way of example—eccentric arrangement of the shells bordering the ring aperture, the compensation can likewise be caused, by the appropriate choice of the tubing diameter. Naturally this holds all the more for smaller differences, as these appear, for example, with a break-out line that is generated by explosive work. The process-conditioned differing inner ring aperture breadths are often distinguished from constructional-conditioned differences in ring aperture breadths by their comparatively greater mass. This in true especially for drill shield thrusting, with which in the starting stretch a comparatively wider ring aperture between shield and the rock or auxiliary structure must be taken into account. Then it is recommended to make use of two or more sealing elements lying within each other which compensate for process-conditioned differing inner ring aperture widths over the aperture periphery. With this the impermeability results from the arrangement of two or more tubular sealing elements within each other, as they had been described above. Among other things, the changed size of the ring aperture in the course of the start and thrusting is also process-conditioned in the above-mentioned drill shield thrusting. With this, there results first a ring aperture with comparably less distance between the rock and the cutting tail, which is enlarged with the fastening and thrusting of the shield behind the shield tail. In these cases it is recommended to make use of the inner sealing element sealing the process-conditioned smaller ring aperture width and the outer sealing element sealing the process-conditioned larger ring aperture width, by which it is possible, by means of the interior sealing element, to seal reliably the smaller inner width of the ring aperture and, with the outer sealing element in connection to it, the process-conditioned larger ring aperture width.

The textile design, according to the invention, of the sealing element described above is preferable. With this, as a rule, hydraulic setting filler-materials in form used underground, mostly quick-setting building material are employed. Of course, other construction materials are also suited for these forms of design, so far as they can be drawn into consideration for the sealing elements, appropriate for the invention, even non-hardening filler material, like, e.g. artificial clay, Betonit, or the like. That is, for permanently flexible aperture sealing, a non-hardening filler should be used, and, for stiff sealing, hardening construction materials should be used, as the filler of the sealing element. If a firm seal, claculable in statics, is required, as, for example, is required in the area of the completion of the thrusting structure, the filling material should be a hydraulic setting material, corresponding to the established requirements. In each case the subsequent removal of the ring seal, as provided by the invention, can be eliminated. It is also advantageous to realize the benefit of a sealing element which is definitely established, since they lead to a considerable simplification in the area of ring aperture seal. Then the superior definite establishment of the sealing element, according to the invention, permits the doing away with corresponding seal seats and mountings. It suffices much more to push the sealing element from the front over the inner shell or to lay it around and then to fill it.

The filling of the textile seal elements, pertinent to the invention, with hydraulic setting construction material has, moreover, the particular advantage that pressures of any magnitude and limited only by the strength of the textile materials may be employed without a safety risk arising from this, as is the case with compressed air. By this it is possible to choose the pressure surface of the seal element and the filling pressure used in the individual case corresponding to the requirements, since the bracing of the seal elements continues to be maintained because of the material properties of the textile tubing material. In such cases should leakage occur, the seal fails only at points and the leakage may be comparatively easily repaired.

With bordered housing services of the sealing element provided with an application made of a flexible longitudinal strip which serves as an additional seal, it is possible to produce a limited elasticity of the ring aperture seal. With this by the application to the installation surface of the seal element, an elasticity is created, which, if necessary, can also be removed at a later time by bracing the application.

The details, further characteristics, and other advantages of the invention result from the following description of the design form of the ring aperture seal, pertinent to the invention, with help of the figures in the diagram.

The tunnel exterior construction reproduced in FIG. 1 is cylindrical and stands in outbreak 1 of the surrounding rock 2. The exterior construction is provisionally secured with a shell 3, not represented in detail, consisting of sprayed concrete. Between the outer shell 3 and, by way of example, the inner, static bearing shell 4 consisting of prefabricated elements, is found a ring aperture, which is seal with a sealing element 5 on its facing side. The sealing element consists of a textile cylindrically woven tube, according to the represented design example. Of course, the circular form of the textile tubing, which results form the cylindrical weave, is not a prerequisite for the invention. Other cross-sectional forms can also be possible. However the cylindrical weave has the advantage that they make the horizontal installation of the tubing easier.

One of the tubing ends is provided with a closure seal 6. The other tubing end is open at 7. The closed tubing end 8 is inserted into the open tubing end 7, so that an overlap 9 over a partial length, depending on the individual case, of the aperture circumference results. The seal element designated as 5 is a ring seal, which serves as front side out-out of ring aperture 10, which is filled at first with a fluid and later with a hardening construction material.

Tubing 11, consisting of textile material, is pushed with the tubing ends, inserted into each other as shown, over the inner shell 4 or before installation fastened to the interior outer construction shell on the exterior outer construction. After this, the tubing is filled under pressure with hardening construction material, beyond the overlap 9, through the fill valves 12–15, leading into the tubing interior. These valves are designed as reverse valves. The tubing is stretched by the internal pressure. Since the diameter d of the tubing is, in the stretched condition, enlarged with respect to the inner aperture width w, there results a deformation of the circular initial circumference under formation by flat construction surfaces on the two shells 3, 4 of the structure. This is based on the fact that the tubing ends that are inserted into each other slide relative to each other by means of the pressure of the tube filling and therefore increase the tubing diameter d wherever sufficient room stands available. In further course of the application of pressure, there come about the flattened mounting surfaces A, B. On these surfaces the required sealing pressure results, by which in the overlap the tubing ends connect while sealing each other, so that no filling material can, under normal circumstances, exit the tubing. The inserted tubing end 8 can be closed, e.g., by means of tucking of the tube, and then needs no cover. The fill valves, which are provided at places 12 to 15 outside the overlap 9, are of a well-known kind and therefore need no description and representation in detail.

Figure 2:
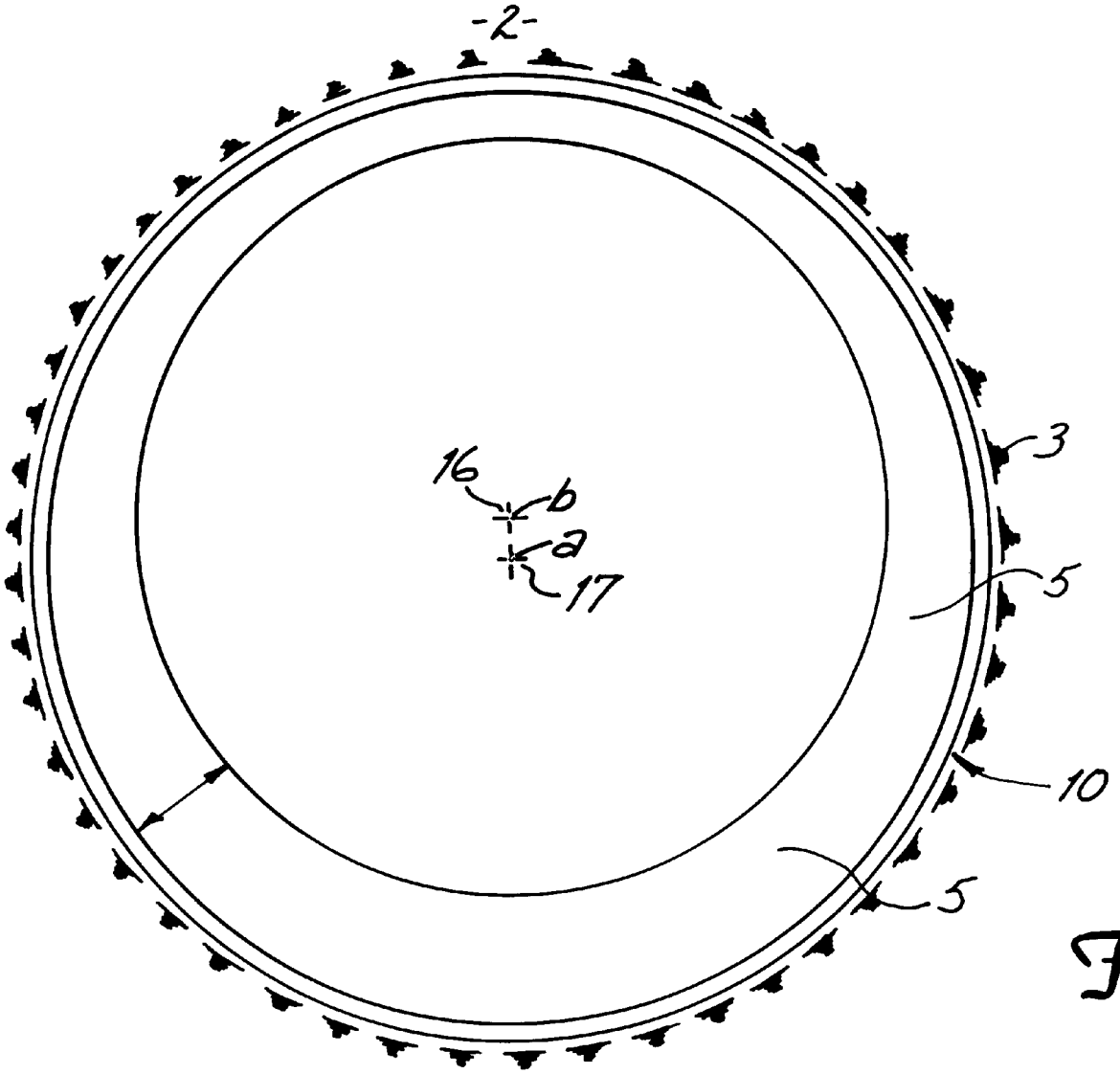
FIG. 2 is a cross-sectional view corresponding to the representation in FIG. 1 but used on a eccentric shell arrangement.
Figure 3:
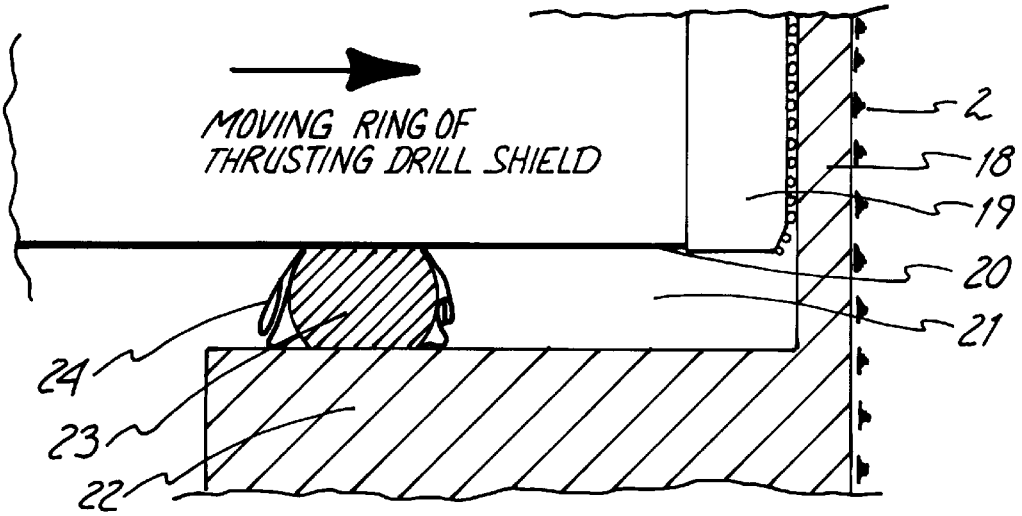
FIG. 3 is cross-sectional view taking along lines 3—3 of FIG. 1 and showing the sealing of the ring aperture of differing sizes in partial longitudinal section through the lower area of a drill shield, during the starting stretch.
Figure 4:
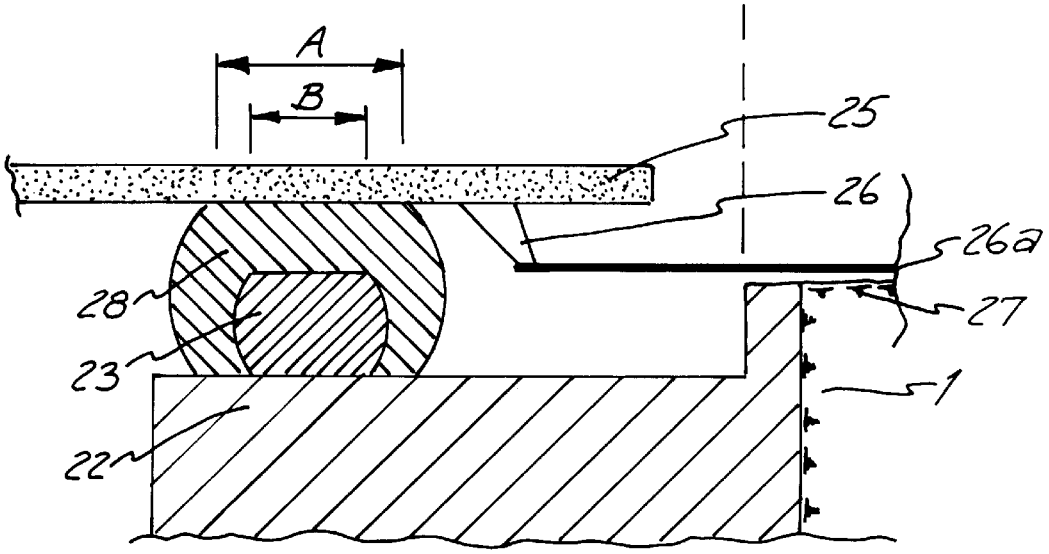
FIG. 4 is a cross-sectional view similar to FIG. 3 taken after the thrusting or advancing of the drill shield and after introduction of filler material into the second casing.

In the representation of FIG. 2, an eccentric arrangement of the inner shell, made of a steel or concrete tube, is taken to be in the outer shell 5. With this, place 16 indicates the penetration point of the longitudinal axis of the outer shell 5, while at 17 the penetration point of the longitudinal axis of the inner shell 4 is depicted. Because the longitudinal axes of the inner and outer shells do not coincide, there results over the entire periphery of the ring aperture 10 a continual difference of the aperture breadth, which is compensated in this way by the simplified sealing element 5, as described, that the tubing diameter d is chosen according to the greatest width w of the ring aperture. By this it differs from the other inner ring aperture widths. The differing inner aperture width w of the ring aperture 10 (illustrated in FIG. 2) result from the construction of the exterior construction. In FIGS. 3 to 12, on the other hand, process-conditioned design forms of the invention are assumed, which reliably seal the width differences of the ring aperture. The surrounding rock for this representation is indicated uniformly again with 2 for this representation. The front wall of the starting tube bears the label-number 18, while the cutting head of the drill shield is marked with 19. The shield tube 20 forms a ring aperture 21 with the side wall 22 of the start tube. The sealing element designated with 23 serves for sealing, which, with the help of FIGS. 1 and 2, is described, built, and arranged. As there, it consists of a cylindrically woven textile tubing. This is arranged concentrically in an external wider sealing element 24, which is built and arranged just like the sealing element 23. The upper representation in FIG. 3 shows the tunnel drill shield, as it stands in the drill shield or start tube and borders the ring aperture 21. The inner tubing element 23 is, as described with the help of FIGS. 1 and 2, stretched with a hardening filler material, so that the sealing of the front side of the ring aperture 21 results. FIG. 4 shows the situation after the incorporation of the thrust. With this is the inner shell 25, which already exists as built in from the bearing structure of the tunnel. On its exterior, packing-seal 26 of the shield tail 26*a* seals. The outbreak line is depicted at 27. The packing of the ring aperture occurs at this stage by means of the concentric external tubing 24, namely by its pressurized filling with hardening construction material, which is depicted at 28. With this the circumstance is taken into account that the ring aperture is greater than with the situation presented in the upper representation.

Figure 5:
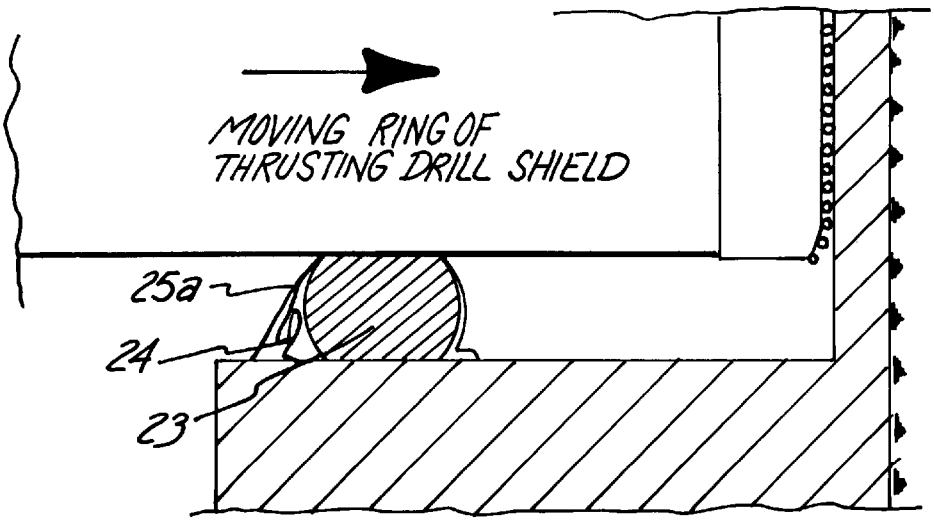
FIGS. 5 and 6 are cross-sectional views similar to FIGS. 3 and 4 but showing a first alternative embodiment of the present invention.
Figure 6:
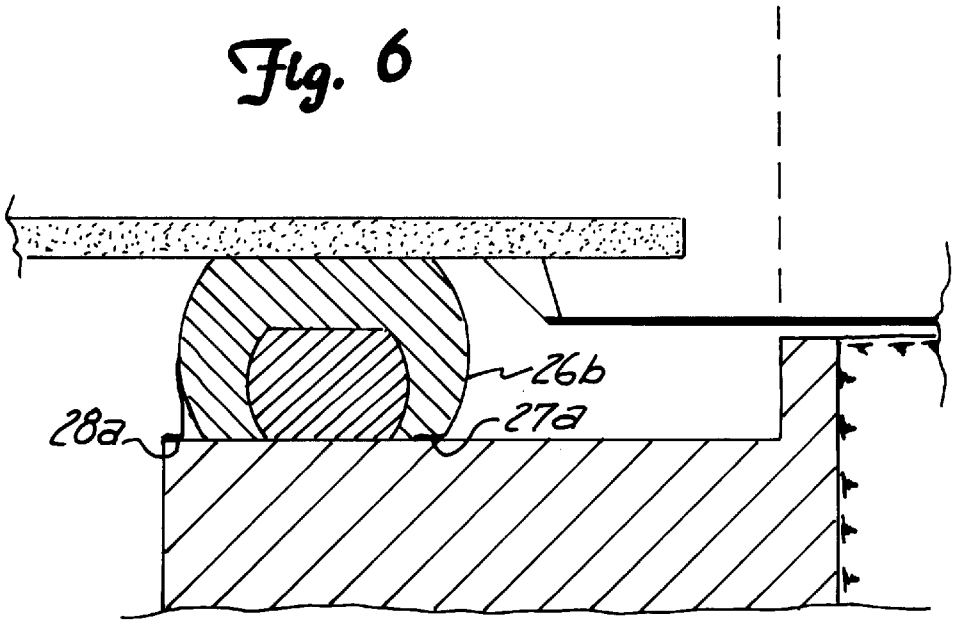
Figure 7:
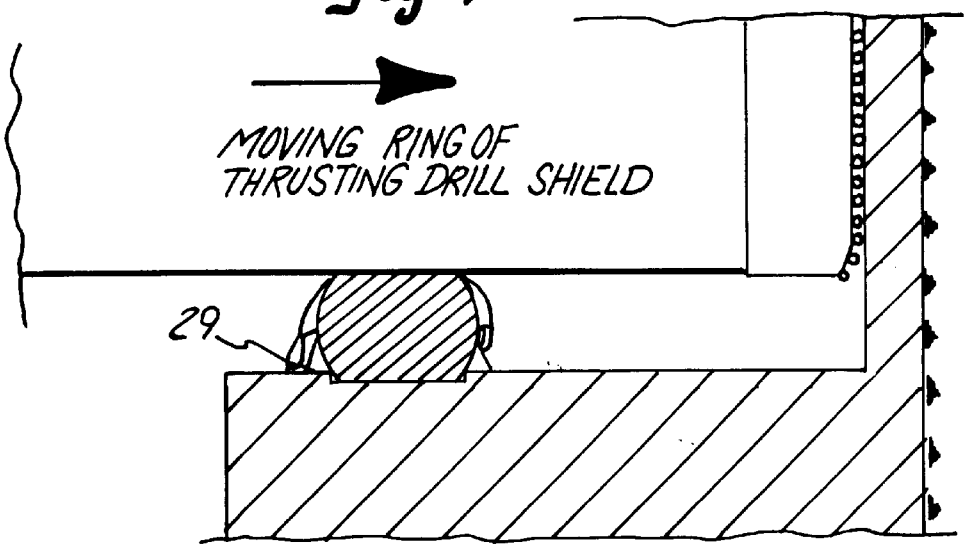
FIGS. 7 and 8 are cross-sectional views similar to FIGS. 3 and 4 but showing a second alternative embodiment of the present invention.
Figure 8:
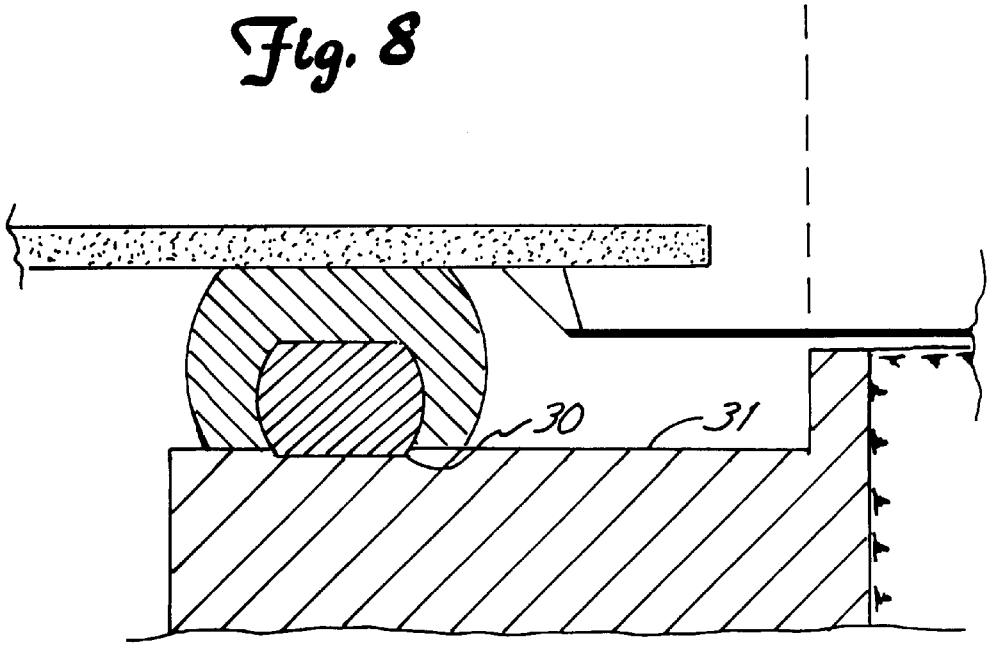

The design form according to FIGS. 5 and 6 differ differs from the design form described earlier insofar as with this the two concentrically arranged sealing elements 23, 24 are installed with a textile fastening 25*a* in the ring aperture on the wall of the start tube. This packing-seal consists for its part of an open tubing 26*b*, which is installed with its folded longitudinal edge 27*a*, 28*a* on the concentric outer shell, for instance, by a stitched-on eye-loop band. The design form according to FIGS. 7 and 8 is distinguished from the design form in FIGS. 5 and 6 by another seal mounting support 29. It consists of a seal seat 30, which is assumed to be on the inner wall 31 of the start tube.

Figure 9:
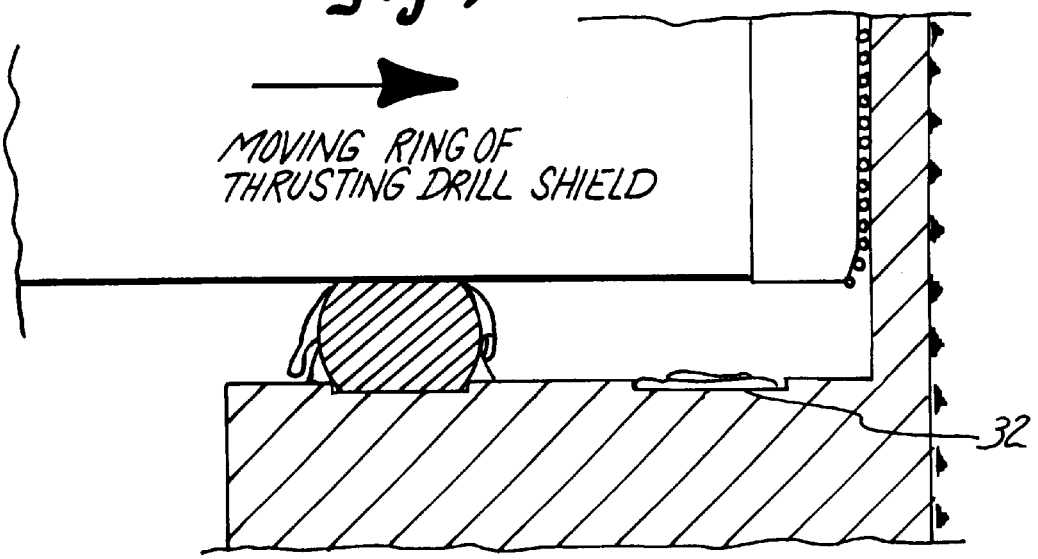
FIGS. 9 and 10 are cross-sectional views similar to FIGS. 3 and 4 but showing a third alternative embodiment of the invention.
Figure 10:
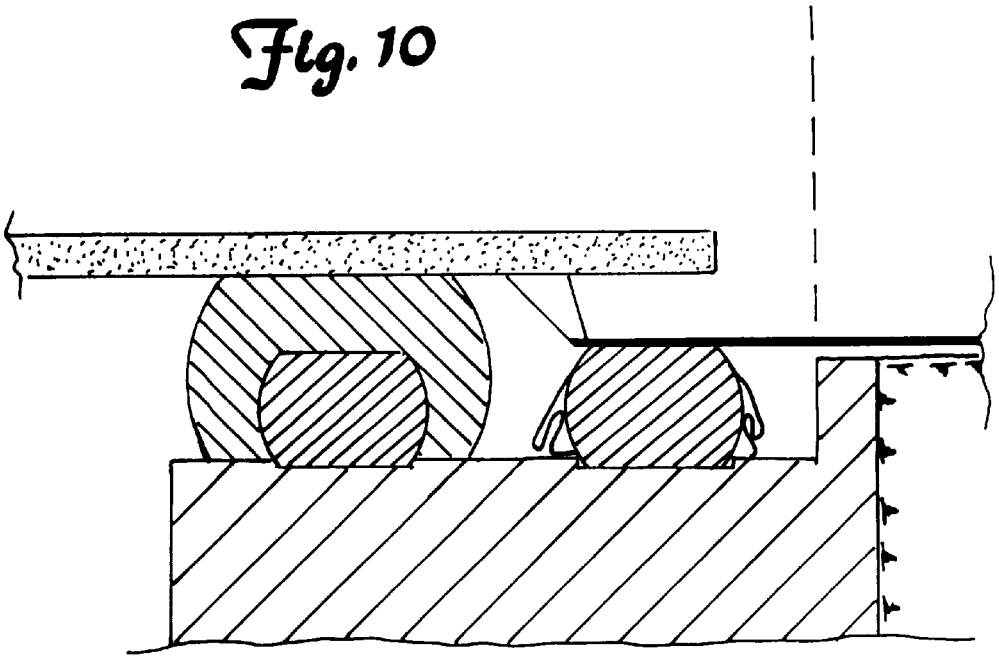

The design form according to FIGS. 9 and 10 prescribes a double seal against high groundwater pressure. For this, at 32 in the upper representation, a further seal-packing is provided, which corresponds to the arrangement, which is represented in FIGS. 7 and 8 and described above.

Figure 11:
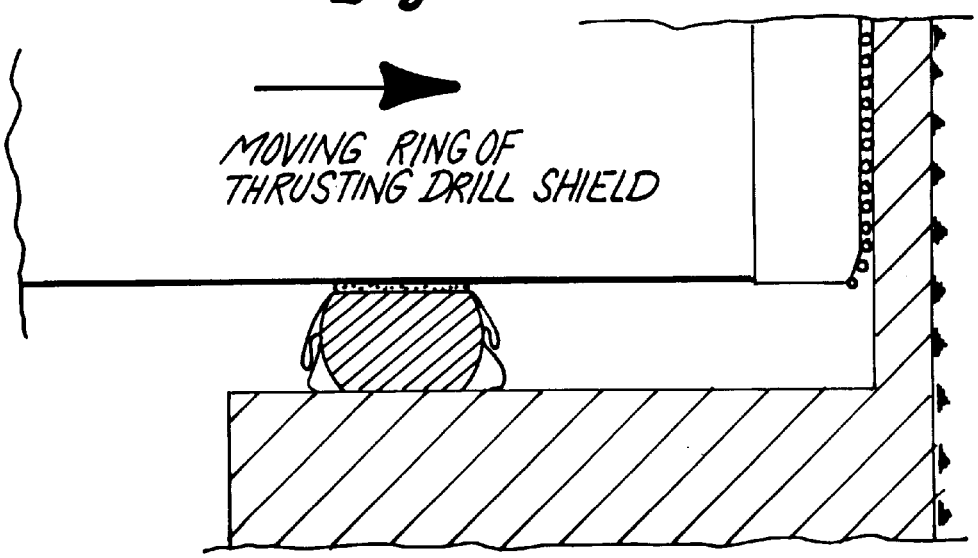
FIGS. 11 and 12 are cross-sectional views similar to FIGS. 3 and 4 but showing a fourth alternative embodiment of the invention.
Figure 12:
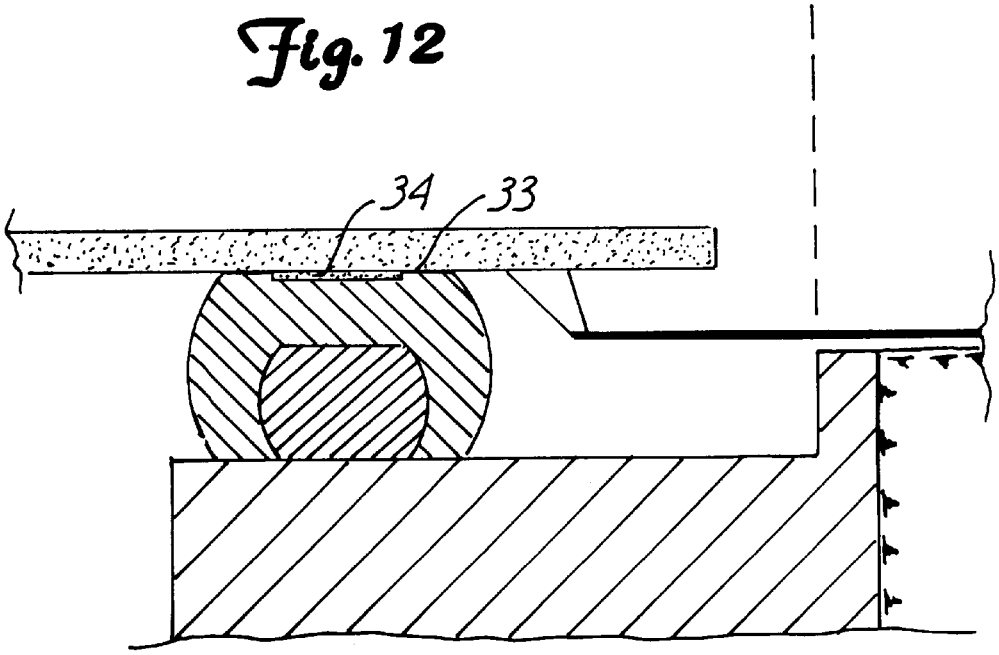

Finally, in the design example of FIGS. 11 and 12, differing from the previously described design forms, an application 34 is provided on the construction surface 33 of the concentric outer sealing element. Application 34 consists of a strip of elastic, flexible material. With this it can be a matter of open-pored plastic strips, which in connection with the application of the sealing element is fastened, for its part, with the help of the hardening construction material and thereby becomes stiff.

The seal construction, described above and portrayed in the Figures in the start phase, is also to be employed in the end phase.

What is claimed is:

1. A ring seal for a multi-shelled structure, the multi-shelled structure having shells separated by a ring aperture, the ring seal comprising:

a tubular sealing element formed of a tubular casing of flexible material having a first end and a second end, the tubular casing formed into a ring with the first end inserted into the second end to overlap the second end, the tubular sealing element being inserted into the ring aperture between shells of the structure; and filler material introduced into the tubular sealing element with a sealing pressure, the filler material stretching the flexible material of the tubular sealing element, the tubular sealing element with filler material therein mating to shell surfaces bordering the ring aperture to apply a seal axially and radially between shells of the structure;

wherein the first end of the tubular casing is closed, and further comprising:

one or more feeder fill valves through which filler material was introduced, the one or more feeder fill valves being located beyond the overlap of the ends.

2. The ring seal according to claim 1, wherein the tubular casing is sealed against the escape of the filler material, which was introduced under pressure, by at least partially opposed application of the first end into the second end.

3. The ring seal according to claim 1, wherein the tubular casing of the tubular sealing element consists of textile material.

4. The ring seal according to claim 1 in combination with the multi-shelled structure, wherein over the periphery of the ring aperture constructionally differing inner ring aperture widths are compensated for by an excess of the sealing element periphery.

5. The ring seal according to claim 1 in combination with the multi-shelled structure, wherein the shells bordering the ring aperture are in an eccentric arrangement thereby causing the ring aperture to have a differing width, and wherein compensation for the differing width is achieved through an excess of the sealing element periphery.

6. The ring seal according to claim 1, wherein the filler material is non-hardening solid filler.

7. The ring seal according to claim 1, wherein the filler material is hardening construction material.

8. A ring seal for a multi-shelled structure, the multi-shelled structure having shells separated by a ring aperture, the ring seal comprising:

a tubular sealing element formed of a tubular casing of flexing material having a first end and a second end, the tubular casing formed into a ring with the first end inserted into the second end to overlap the second end, the tubular sealing element being inserted into the ring aperture between shells of the structure;

filler material introduced into the tubular sealing element with a sealing pressure, the filler material stretching the flexible material of the tubular sealing element, the tubular sealing element with filler material therein mating to shell surfaces bordering the ring aperture to apply a seal axially and radially between shells of the structure; and a second sealing element lying within the tubular casing of the tubular sealing element.

9. The ring seal according to claim 8, wherein the filler material is non-hardening solid filler.

10. The ring seal according to claim 8, wherein the filler material is hardening construction material.

11. A ring seal for a multi-shelled structure, the multi-shelled structure having shells separated by a ring aperture, the ring seal comprising:

a tubular sealing element formed of a tubular casing of flexible material having a first end and a second end, the tubular casing formed into a ring with the first end inserted into the second end to overlap the second end, the tubular sealing element being inserted into the ring aperture between shells of the structure; and filler material introduced into the tubular sealing element with a sealing pressure, the filler material stretching the flexible material of the tubular sealing element, the tubular sealing element with filler material therein mating to shell surfaces bordering the ring aperture to apply a seal axially and radially between shells of the structure, wherein the filler material is hardening construction material.

12. The ring seal according to claim 11, wherein the tubular casing is sealed against the escape of the filler material, which was introduced under pressure, by at least partially opposed application of the first end into the second end.

13. The ring seal according to claim 11, wherein the tubular casing of the tubular sealing element consists of textile material.

14. A method of using a ring seal to seal a ring aperture between shells of a multi-shelled structure, comprising the acts of:

providing a casing tube of a flexible material with a first end, a second end, and a fill opening;

overlapping the first end of the casing tube with the second end of the casing tube to form a tubular sealing element;

inserting the tubular sealing element into the ring aperture between the shells; and introducing filler material into the tubular sealing element through the fill opening with a sealing pressure, thereby forming a seal between the shells, wherein the overlapping act creates an overlap length where the first end and the second end overlap, and wherein the act of introducing filler material into the tubular sealing element causes shortening of the overlap length.

15. The method of claim 14, wherein the act of introducing filler material into the tubular sealing element comprises stretching the flexible material of the tubular sealing element.

16. The method of claim 14 wherein the filler material is fluid during the introducing act, and further comprising the act of hardening the filler material.

17. The method of claim 14, wherein the overlapping act comprising inserting the first end into the second end.

18. The method of claim 14, wherein the fill opening comprises one or more feeder fill valves, and wherein the filler material is introduced through the one or more feeder fill valves.

19. The method of claim 14, further comprising:

providing a second sealing element lying within the casing tube of the tubular sealing element;

introducing filler material into the second sealing element with a sealing pressure, thereby forming a seal when the ring aperture has a first configuration; and changing the ring aperture to a second configuration;

wherein the act of introducing filler material into the tubular sealing element is performed after the ring aperture is in the second configuration.

20. The method of claim 19, wherein the first configuration of the ring aperture has a first width, and wherein the second configuration of the ring aperture has a second width which differs from the first width.

* * * * *